US005377772A

United States Patent [19]

Gien

[11] Patent Number: 5,377,772

[45] Date of Patent: Jan. 3, 1995

[54] DRILL STRING SHOCK ABSORBERS

[76] Inventor: Bernard L. Gien, P.O. Box 471, Edenvale 1610, South Africa

[21] Appl. No.: 218,742

[22] Filed: Mar. 28, 1994

[30] Foreign Application Priority Data

Apr. 27, 1993 [ZA] South Africa ..... 93/2927

[51] Int. Cl.[6] ..... E21B 17/00

[52] U.S. Cl. ..... 175/325.5

[58] Field of Search ..... 175/325.5, 325.1, 325.2, 175/320

[56] References Cited

U.S. PATENT DOCUMENTS 1,861,815 6/1932 Radford ..... 175/325.5
2,482,962 9/1949 Boice ..... 175/325.5 X
4,279,850 7/1981 Lynch ..... 175/325.5 X
5,234,063 8/1993 Collinsworth ..... 175/325.2

*Primary Examiner*—Michael Powell Buiz
*Attorney, Agent, or Firm*—McAulay Fisher Nissen Goldberg & Kiel

[57] ABSTRACT

A shock absorber for use with a borehole drill string and which is to take a rotational load and absorb axial shock loading, the absorber consisting essentially of a pair of oppositely disposed components adapted for connection into a drill string and positioned on opposite sides of a resilient member, the latter being held between rigid rings around and separate from the components, each ring being secured to the component on the opposite side of the member.

10 Claims, 1 Drawing Sheet

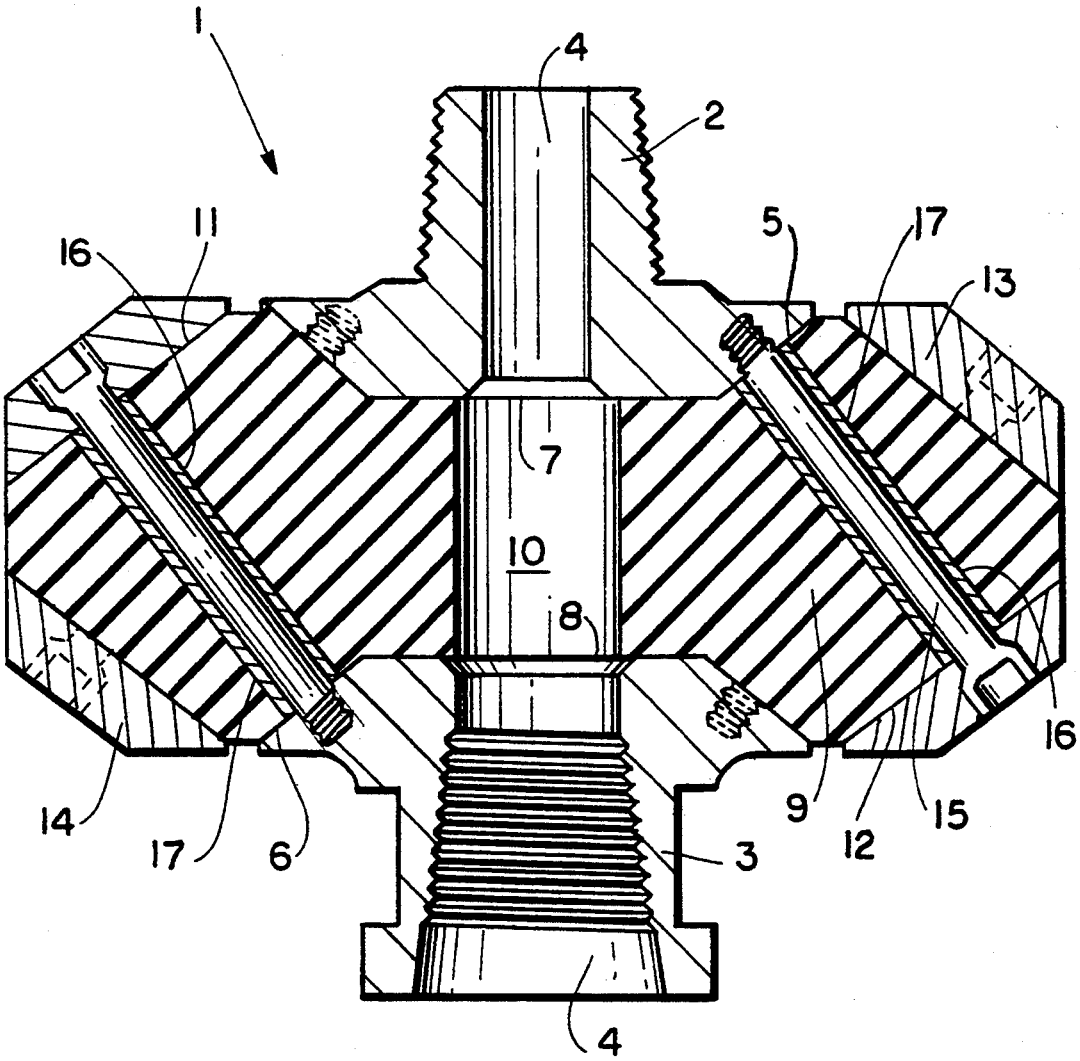
1
4
2
16
11
5
17
13
7
10
8
16
14
17
6
3
9
12
15
4

DRILL STRING SHOCK ABSORBERS

This invention relates to shock absorbers which are included in drill strings and with borehole drilling machines.

BACKGROUND OF THE INVENTION

Drilling machines utilise drill strings to transmit power down predrilled holes to a drill bit at the bottom of the hole. The drill bit may be operated by a down-the-hole hammer assembly or by a rotary action.

Whatever method is used it is highly desirable that a shock-absorber be incorporated in the drill string between the bit and the driving head. This is usually done by positioning the shock-absorber between the driving head and the first drill rod of the drill string.

Known types of shock absorbers, which must absorb axial shock loading and the torque applied to the drill string, have either cumbersome casings with two sets of rubber elements or one element with straps holding the top and bottom halves of the shock absorbers together.

OBJECT OF THE INVENTION

It is the object of this invention to provide a shock absorber of the kind referred to which will transmit torque through a resilient member which will also absorb axial shock loading applied to the drill string with which it is used.

SUMMARY OF THE INVENTION

According to this invention there is provided a shock absorber for use with a drilling machine comprising a pair of oppositely disposed components adapted for connection into a drill string and positioned on opposite sides of a resilient member the latter held between rigid rings around and separate from the components each ring secured to the component on the opposite side of the member.

Further features of this invention provide for the securing means to be bolts extending inwardly through the resilient member from the rings to the components and for the rings to seat on faces of the resilient member inclined to the axis of the components.

The invention also provides for the bolts to be located in spacer sleeves and for the resilient member to be a block of suitable elastomeric material with an axial passage therethrough.

BRIEF DESCRIPTION OF THE DRAWING

A preferred embodiment of this invention is described below with reference to the accompanying drawing which illustrates one form of shock absorber in cross-section.

DETAILED DESCRIPTION OF THE DRAWING

As shown the shock absorber (1) consists of a pair of components (2) and (3) one adapted for connection to a drilling head and the other to the first drill rod of a drill string for a borehole drill bit. The components have an axial passageway (4) therethrough.

The components have inclined faces (5) and (6) which enable their oppositely disposed ends (7) and (8) to be countersunk into a resilient member in the form of a block (9) of elastomeric material. This material is preferably polyurethane. The block also has an axial passage (10) therethrough. The peripheral corners of the block (9) are chamfered to provide surfaces (11) and (12) against which rigid rings (13) and (14) seat. These rings are bored to receive bolts (15) which extend through holes (16) through the block (9) so that each ring is bolted to the component on the opposite side of the block (9). That is, ring (13) is secured to component (3) and ring (14) is secured to component (2).

Spacer sleeves (17) are provided in the holes (16) around the bolts (15).

The assembly forms a compact unit which can readily transmit torque and which will absorb axial shocks applied through the drill string in use.

It will be appreciated that this invention is not limited to the particular example described. Variations may be made and in particular the resilient member need not be of the shape described but can be a flat ring.

It will be appreciated that the securing means described above as being bolts is not the only suitable means for securing the components together. It is quite possible to have pins and plates or washers which are welded in position. Due to the angle of the pins through the block of material it will not be necessary to weld the inner ends of the pins, and plates around the outer ends can be welded in position. It will in most cases however be advantageous to have the inner ends of the pins also welded in position.

I claim:

1. A shock absorber for use with a drilling machine, comprising:

a pair of oppositely disposed components adapted for connection into a drill string and positioned on opposite sides of a resilient member;

said resilient member being held between rigid rings around and separate from the components;

each said ring being secured to one of said oppositely disposed components and on the opposite side of said resilient member.

2. A shock absorber for use with a drilling machine as claimed in claim 1, including securing means for securing each said ring to its respective said oppositely disposed component, said securing means being bolts extending inwardly through the resilient member from the rings to the components.

3. A shock absorber for use with a drilling machine as claimed in claim 1, in which the rings seat on faces of the resilient member inclined to the axis of the components.

4. A shock absorber for use with a drilling machine as claimed in claim 2, in which the bolts are located in spacer sleeves.

5. A shock absorber for use with a drilling machine as claimed in claim 1, in which the resilient member is a block of elastomeric material having an axial passage therethrough.

6. A shock absorber for use with a drilling machine as claimed in claim 2, in which each said resilient member is provided with a face inclined to the axis of its said respective components, and said ring seats on said face.

7. A shock absorber for use with a drilling machine as claimed in claim 3, including spacer sleeves, and said bolts being located in said spacer sleeves.

8. A shock absorber for use with a drilling machine as claimed in claim 2, in which said resilient member is a block of elastomeric material provided with an axial passage therethrough.

9. A shock absorber for use with a drilling machine as claimed in claim 3, in which said resilient member is a block of elastomeric material provided with an axial passage therethrough.

10. A shock absorber for use with a drilling machine as claimed in claim 4, in which said resilient member is a block of elastomeric material provided with an axial passage therethrough.

* * * * *